US007540802B2

(12) United States Patent
Nonoshita et al.

(10) Patent No.: US 7,540,802 B2
(45) Date of Patent: Jun. 2, 2009

(54) CMP PAD CONDITIONER

(75) Inventors: Tetsuya Nonoshita, Kurume (JP); Naoki Toge, Kurume (JP)

(73) Assignees: Noritake Co., Limited, Nagoya (JP); Noritake Super Abrasive Co., Ltd., Kurume (JP)

( * ) Notice: Subject to any disclaimer, the term of this patent is extended or adjusted under 35 U.S.C. 154(b) by 0 days.

(21) Appl. No.: 11/714,846

(22) Filed: Mar. 7, 2007

(65) Prior Publication Data

US 2007/0218821 A1 Sep. 20, 2007

(30) Foreign Application Priority Data

Mar. 14, 2006 (JP) ..... 2006-068855

(51) Int. Cl.
*B24B 55/00* (2006.01)

(52) U.S. Cl. ..... 451/443

(58) Field of Classification Search ..... 451/443
See application file for complete search history.

(56) References Cited

U.S. PATENT DOCUMENTS 6,001,008 A * 12/1999 Fujimori et al. ..... 451/443
6,213,856 B1 * 4/2001 Cho et al. ..... 451/443
6,325,709 B1 * 12/2001 Nanda et al. ..... 451/443
6,884,155 B2 * 4/2005 Sung et al. ..... 451/443
2003/0084894 A1 * 5/2003 Sung ..... 125/12
2005/0215188 A1 * 9/2005 Toge et al. ..... 451/444

FOREIGN PATENT DOCUMENTS

JP A 2001-113456 4/2001
JP A 2003-305644 10/2003
JP A 2005-161440 6/2005

* cited by examiner

*Primary Examiner*—Maurina Rachuba
(74) *Attorney, Agent, or Firm*—Oliff & Berridge, PLC

(57) ABSTRACT

A CMP pad conditioner is provided with a grinding part formed by fixing abrasive grains on a metal base by soldering, wherein the grinding part has a flat part near an inner periphery and an inclined part near an outer periphery, wherein abrasive grains having regular shapes are fixed to the flat part, and wherein abrasive grains having acute shapes are fixed to the inclined part.

3 Claims, 1 Drawing Sheet

CMP PAD CONDITIONER

The present application claims the benefits of Japanese Patent Application No. 2006-068855 filed on Mar. 14, 2006.

BACKGROUND OF THE INVENTION

1. Field of the Invention

The present invention relates to a CMP pad conditioner used in a CMP device used for flattening a surface of a silicon wafer or the like.

2. Description of the Related Art

As a method of flattening a surface of a silicon wafer or the like, chemical mechanical polishing (abbreviated as "CMP," hereinafter) has been used often in recent years.

FIG. 2 shows a configuration of a CMP device used conventionally.

In FIG. 2, a CMP device 51 includes a polishing head 54 and a conditioner 55 provided on a revolving table 53 that revolves about a revolving table shaft 52. A polishing pad 56 is formed on the upper surface of the revolving table 53.

The polishing head 54 includes a polishing head shaft 57 and a disk-shaped wafer carrier 58. A wafer 59 is suctioned onto a lower surface of the wafer carrier 58. The disk-shaped wafer carrier 58 revolves about the polishing head shaft 57.

The conditioner 55 includes a conditioner shaft 60 and a disk-shaped conditioning disk 61. The conditioning disk 61 revolves about the conditioner shaft 60.

A slurry supplying unit 62 supplies slurry 63 serving as abrasive material onto the polishing pad 56. The slurry 63 is incorporated into a contact surface between the wafer 59 and the polishing pad 56. The surface of the wafer 59 contacts with the polishing pad 56 on the revolving table 53 surface, and is ground with the slurry 63.

Abrasive grains composed of diamond or the like are fixed on an outer periphery lower surface of the conditioning disk 61. Then, the abrasive grains are rubbed against the polishing pad 56, and thereby grinds the polishing pad 56 surface. By virtue of this, the state is maintained that the surface of the polishing pad 56 is fluffed, so that the polishing condition can be constantly maintained.

Various improvements have been made for the CMP pad conditioner. An example of such techniques is described in Patent Documents 1, 2, and 3.

[Patent Document 1] Japanese Published Unexamined Patent Application No. 2003-305644

[Patent Document 2] Japanese Published Unexamined Patent Application No. 2005-161440

[Patent Document 3] Japanese Published Unexamined Patent Application No. 2001-113456

In a dresser for CMP processing described in Patent Document 1, plural lines of ridges are formed concentrically in an outer periphery part of a side face of a disk-shaped metal base. Then, the height of the ridge on an outer periphery side among the plural lines of ridges is formed lower than the height of the ridge of a middle part, while a layer of abrasive grains are fixed by soldering on the upper surfaces of these ridges. Further, in a pad conditioner described in Patent Document 2, super abrasive grains of two kinds having different grain sizes from each other are used. Then, super abrasive grains in a top part have the larger grain size, while those in a foot part have the smaller grain size.

In a CMP pad conditioner, the polishing pad is required to be grinded stably and flatly. Nevertheless, these two performance requirements conflict with each other, and hence these have been difficult to satisfy simultaneously.

Further, in a conditioner for CMP device described in Patent Document 3, a super abrasive grain surface having a blunt edge is provided on an inner periphery side of an end face that contacts with a polishing pad surface, while a super abrasive grain surface having a sharp edge is provided on an outer periphery side. In this conditioner for CMP device, the super abrasive grain surface having a blunt edge is provided on the inner periphery side, so that the flatness of the pad can be improved effectively. At the same time, the abrasive grain surface having a sharp edge is provided on the outer periphery side, so that the pad can be conditioned effectively.

Nevertheless, even when the abrasive grain surface having a sharp edge formed on the outer periphery side is provided, since the abrasive grains themselves do not have sharp edges, the abrasive grains located in the outermost periphery are solely effective in the grinding. This prevents stable grinding.

SUMMARY OF THE INVENTION

The present invention has been devised in order to solve the above-mentioned problems. An object of the present invention is to provide a CMP pad conditioner capable of grinding a polishing pad stably and flatly.

The object indicated above may be achieved according to a first aspect of the invention, which provides a CMP pad conditioner provided with a grinding part formed by fixing abrasive grains on a metal base by soldering, wherein the grinding part has a flat part near an inner periphery and an inclined part near an outer periphery, wherein abrasive grains having regular shapes are fixed to the flat part, and wherein abrasive grains having acute shapes are fixed to the inclined part.

Since abrasive grains having regular shapes are fixed to the flat part, the polishing pad can be ground flatly. At the same time, since abrasive grains having acute shapes are fixed to the inclined part, the polishing pad can be ground stably. Thus, flatness and stability in the grinding are satisfied simultaneously.

Further, if the abrasive grains of acute shape were fixed by electrodeposition, the abrasive grains would merely be caulked mechanically by plating. Thus, problems arise as follows. That is, since the abrasive grains have distorted shapes, the abrasive grains cannot be held unless the plating has a sufficient thickness. On the contrary, in the case of an excessive thickness, this prevents stable and high grindability that could be achieved by the abrasive grains of acute shape. In contrast, when the abrasive grains are fixed by soldering, the abrasive grains can be held firmly even with a solder of small thickness. This allows the abrasive grains of acute shape to act effectively.

The object indicated above may be achieved according to a second aspect of the invention, which provides the CMP pad conditioner according to the first aspect of the invention, wherein the inclined part has a shape of which the thickness is reduced toward the outer periphery side, and wherein the thickness difference between an outermost periphery and an innermost periphery of the inclined part is 10% or greater and 50% or smaller of an average grain size of the abrasive grains.

When the thickness difference between the outermost periphery and the innermost periphery of the inclined part is less than 10% of the average grain size of the abrasive grains, since the variation in the grain size of the abrasive grains is, generally, 10% of the average grain size of the abrasive grains, the variation in the grain size of the abrasive grains exceeds the thickness difference. Thus, the abrasive grains in the inclined part do not act uniformly. This situation is not preferable. On the other hand, in the case that the difference exceeds 50% of the average grain size of the abrasive grains, when the cut depth becomes large such that the abrasive grains in the outermost periphery should act, the load to the abrasive grains on the inner periphery side becomes excessive. This situation is not preferable.

The object indicated above may be achieved according to a third aspect of the invention, which provides the CMP pad conditioner according to the first aspect of the invention, wherein variation in tip height values of the abrasive grains fixed to the flat part is 10% or smaller of an average grain size of the abrasive grains.

When appropriate variation is imparted to the tip height values of the abrasive grains, flatness in the processing is achieved in a state that a grinding effect is maintained to some extent.

When the variation in the tip height values of the abrasive grains fixed to the flat part exceeds 10% of the average grain size of the abrasive grains, the abrasive grains do not act uniformly. Thus, smoothness in the pad is not obtained. This situation is not preferable.

According to the present invention, a CMP pad conditioner is realized that can grind a polishing pad stably and flatly.

DETAILED DESCRIPTION OF THE PREFERRED EMBODIMENTS

The present invention is described below with reference to an embodiment.

A CMP pad conditioner of the present invention is described below with reference to an embodiment.

Figure 1:
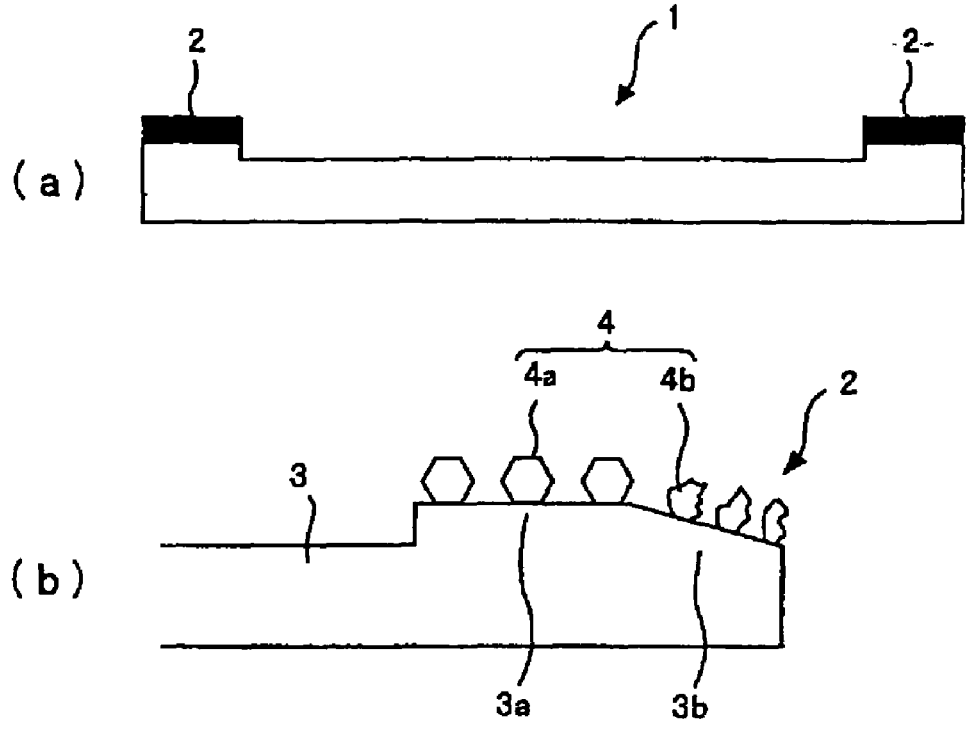
FIG. 1 is a diagram showing a configuration of a CMP pad conditioner according to an embodiment of the present invention.
Figure 2:
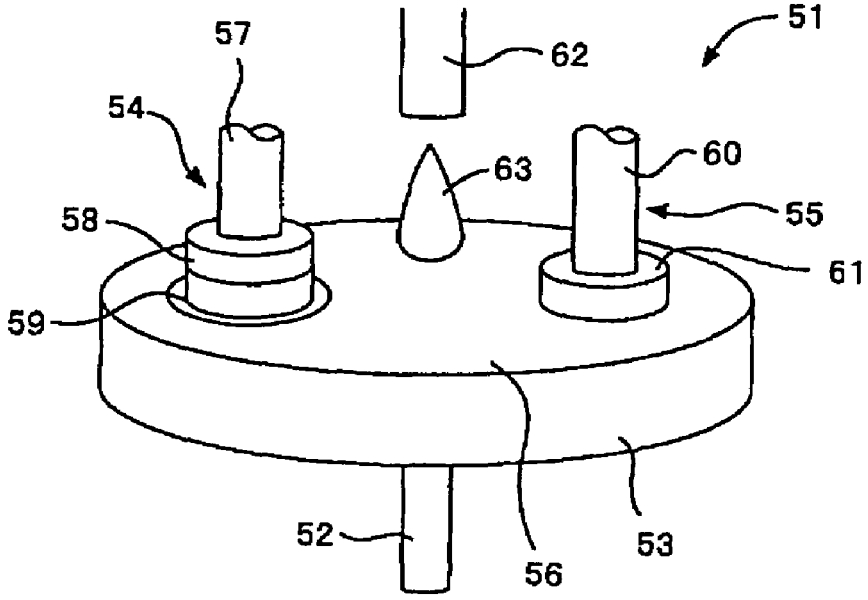
FIG. 2 is a diagram showing a configuration of a CMP device used conventionally.

FIG. 1 shows a configuration of a CMP pad conditioner according to an embodiment of the present invention. FIG. 1(*a*) shows a conditioning disk of the CMP pad conditioner, where a grinding part 2 is provided on an outer periphery side of a conditioning disk 1.

FIG. 1(*b*) shows details of the grinding part 2. The grinding part 2 is formed in such a manner that abrasive grains 4 are fixed by soldering with a solder material such as Ni—Cr onto a metal base 3 composed of a metallic material such as steel and copper alloy. The abrasive grains 4 may be composed of diamond or the like. The metal base 3 includes a flat part 3*a* near the inner periphery and an inclined part 3*b* near the outer periphery. Abrasive grains 4*a* having regular shapes are fixed to the flat part 3*a*, while abrasive grains 4*b* having acute shapes are fixed to the inclined part 3*b*.

The abrasive grains 4*a* having regular shapes indicate those having an average shape coefficient of 1 or greater and smaller than 1.2. The abrasive grains 4*b* having acute shapes indicate those having an average shape coefficient of 1.2 or greater. In particular, it is preferable that the abrasive grains 4*b* having acute shapes have a shape coefficient of 1.3 or greater. Here, when the shape of an abrasive grain is viewed on a two-dimensional projection plane, the shape coefficient indicates a value ($=L^2/4\pi S$) obtained by dividing the circumference L multiplied by itself by the area S multiplied by $4\pi$. The shape coefficient of 1 indicates a complete circle (complete sphere).

The inclined part 3*b* has a shape that the thickness becomes thin toward the outer periphery side. The thickness difference between the outermost periphery and the innermost periphery of the inclined part 3*b* is 10% or greater and 50% or smaller of the average grain size of the abrasive grains. Further, the variation in the tip height values of the abrasive grains 4*a* having regular shapes fixed to the flat part 3*a* is 10% or smaller of the average grain size of the abrasive grains.

A concrete example of a test is described below.

A grinding test has been carried out by using a dresser having the following specifications under the following test conditions.

Dresser Specifications
Dimensions: $\phi 100 \times 10$ W
Grain size of abrasive grains: #100/120
Solder: Ni—Cr
Test Conditions
Machine: Polishing machine
Pad: Foamed polyurethane $\phi 300$
Dresser revolving speed: 90 $min^{-1}$
Table revolving speed: 100 $min^{-1}$
Processing pressure: 30 N
Processing time: 30 Hr Results of the grinding test are shown in Table 1.

TABLE 1

| | Pad grindability (μm/Hr) | Pad flatness (%) |
|---|---|---|
| Comparison Example 1 | 100 ± 30 | 100 ± 30 |
| Comparison Example 2 | 30 ± 10 | 70 ± 10 |
| Comparison Example 3 | 120 ± 10 | 120 ± 10 |
| Example 1 | 105 ± 10 | 80 ± 10 |
| Example 2 | 120 ± 10 | 80 ± 10 |

In Table 1, in Comparison Example 1, abrasive grains having acute shapes of a shape coefficient of 1.21 were solely arranged in the grinding part. In Comparison Example 2, abrasive grains having regular shapes of a shape coefficient of 1.15 were solely arranged in the grinding part. In Comparison Example 3, abrasive grains having shape coefficients between 1.25 and 1.3 were arranged as described in Patent Document 2. In Examples 1 and 2, abrasive grains were arranged as shown in FIG. 1 of the present invention. In Example 1, the acute abrasive grains used had a shape coefficient of 1.21, while the regular abrasive grains used had a shape coefficient of 1.15. In Example 2, the acute abrasive grains used had a shape coefficient of 1.33, while the regular abrasive grains used had a shape coefficient of 1.15. Each numerical value in Table 1 is expressed under normalization that the average in Comparison Example 1 is adopted as 100. The pad grindability is defined by the amount of pad removed per unit time. The pad flatness is defined as an amount where a smaller value indicates a flatter surface.

When compared with Comparison Example 1, in Comparison Example 2, since abrasive grains having regular shapes were used solely, pad flatness has been improved, but pad grindability has been degraded. Further, in Comparison Example 3, pad grindability has been improved, but pad flatness has been degraded.

In contrast, when compared with Comparison Example 1, in Example 1, pad flatness and pad grindability have both been improved. That is, simultaneous improvement in pad flatness and pad grindability has been realized. Further, in Example 2, pad grindability has been improved further when compared with Example 1.

The present invention is applicable to a CMP pad conditioner capable of grinding a polishing pad stably and flatly.

What is claimed is:

1. A CMP pad conditioner provided with a grinding part formed by fixing abrasive grains on a metal base by soldering, wherein the grinding part has a flat part near an inner periphery and an inclined part near an outer periphery, the inclined part having a shape of which the thickness is reduced toward the outer periphery side, and the thickness difference between an outermost periphery and an innermost periphery of the inclined part being 10% or greater and 50% or smaller of an average grain size of the abrasive grains, and wherein abrasive grains having regular shapes are fixed to the flat part, and wherein abrasive grains having acute shapes are fixed to the inclined part, variation in tip height values of the abrasive grains fixed to the flat part is 10% or smaller of an average grain size of the abrasive grains, the abrasive grains having regular shapes and being fixed to the flat part have a shape coefficient smaller than 1.2, and the abrasive grains having acute shapes and being fixed to the inclined part have a shape coefficient of 1.2 or greater.

2. The CMP pad conditioner according to claim 1, wherein the abrasive grains having acute shapes fixed to the inclined part have a shape coefficient of 1.3 or greater.

3. The CMP pad conditioner according to claim 1, wherein the abrasive grains are diamond abrasive grains soldered to the metal base by using Ni—Cr.

* * * * *